United States Patent [19]

Dürig et al.

[11] Patent Number: 4,552,195

[45] Date of Patent: Nov. 12, 1985

[54] STRIP CURTAIN

[75] Inventors: Heinz Dürig, Ostermundigen; Hans Grützner, Kehrsatz; Konrad Bratschi, Muri, all of Switzerland

[73] Assignee: K. Bratschi, Silent Gliss, Muri, Switzerland

[21] Appl. No.: 447,698

[22] Filed: Dec. 7, 1982

[30] Foreign Application Priority Data

Dec. 7, 1981 [CH] Switzerland ..... 7812/81

[51] Int. Cl.[4] ..... E06B 9/307; E06B 9/26

[52] U.S. Cl. ..... 160/168 R; 160/166 A

[58] Field of Search ..... 160/166 R, 166 A, 168, 160/176, 172

[56] References Cited

U.S. PATENT DOCUMENTS

| | | | |
|---|---|---|---|
| 3,996,388 | 12/1976 | deWit | 160/168 R |
| 4,102,381 | 7/1978 | Bratschi | 160/168 R |
| 4,316,493 | 2/1982 | Arena | 160/168 R |

FOREIGN PATENT DOCUMENTS

| | | | |
|---|---|---|---|
| 2060743 | 5/1981 | United Kingdom | 160/166 A |

*Primary Examiner*—Ramon S. Britts
*Assistant Examiner*—Cherney S. Lieberman
*Attorney, Agent, or Firm*—Weiser & Stapler

[57] ABSTRACT

The strip curtain has a plurality of glide elements which are guided by a curtain rod and connected with each other by separation-limiting devices. The free hanging curtain strips are suspended from vertical pivot axes with limited excursion. Operation of the pivot axis is by a pinion which engages a bead chain that is slidably guided by the curtain rod. The pinion is connected to the pivot axis by a worm drive, a slip coupling being provided between the pinion and the worm drive. The bead chain serves as common drive for producing pivotal movement and sliding movement of the curtain strips. The strip curtain is of simple construction and therefore reliable in operation and inexpensive and suitable for mass production.

27 Claims, 20 Drawing Figures

FIG.9
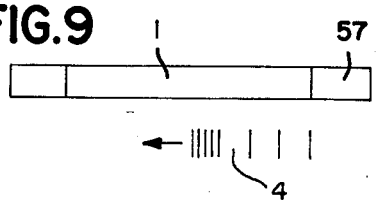
FIG.10
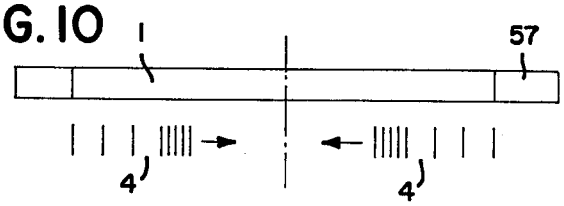
FIG.11
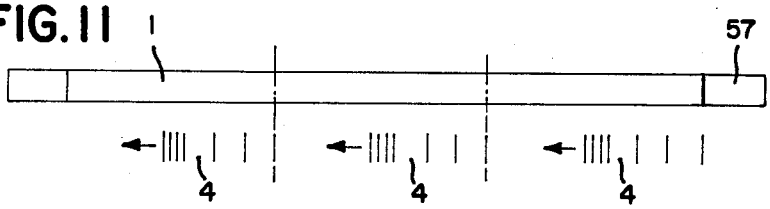
FIG.12
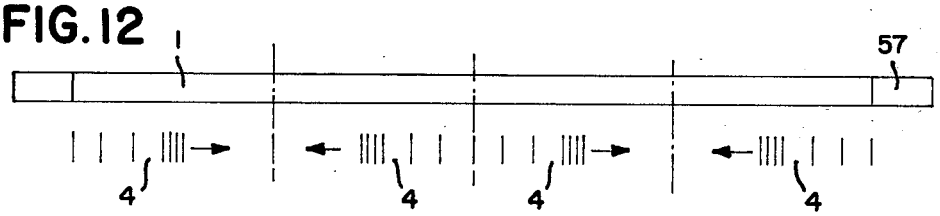
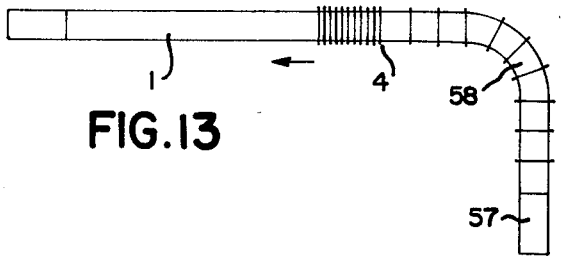
FIG.13

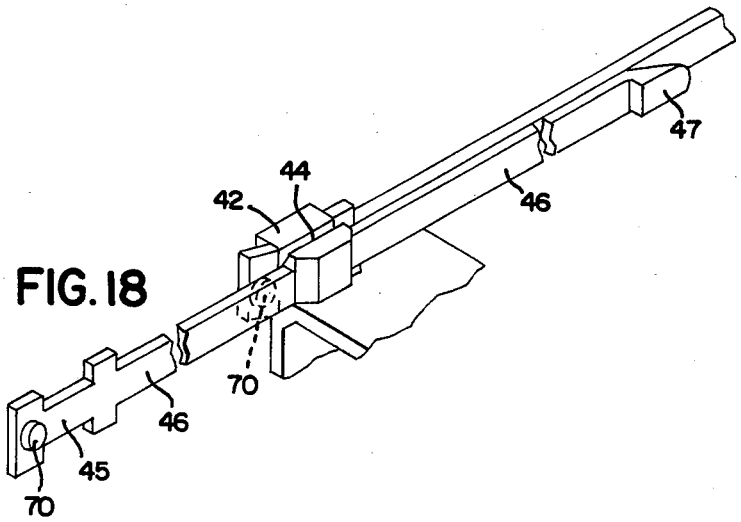
FIG. 18
FIG. 19
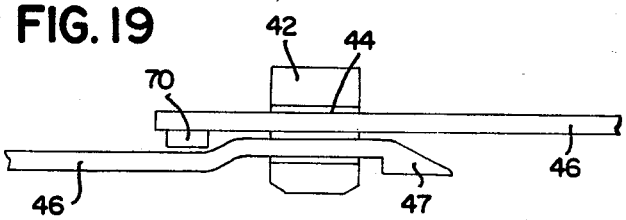
FIG. 20
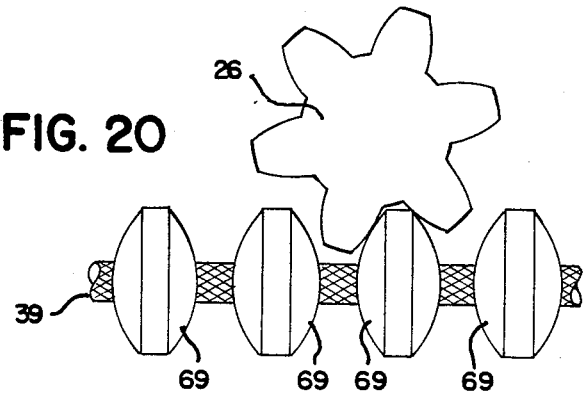

STRIP CURTAIN

The invention relates to a strip curtain of the type defined in patent claim 1.

From French Pat. No. 2,293,569, there is known such a curtain in which the curtain rod guides a rack which is longitudinally displaceable. Pinions connected with the pivot axes of the curtain strips respectively engage the rack in such manner that sliding displacement of the latter causes the freely hanging curtain strips to correspondingly pivot. A drawstring is provided for displacement of the rack.

In order to position the curtain strips parallell to each other, the carriers of the curtain strips are inserted pivotably in the hollow pivot axis and these carriers are rotated by means of the existing friction along with the pivot axis. Through this mounting of the curtain strips there is formed a simple coupling which not only permits a straightening of a curtain strip but also prevents damage when the curtain strips strike against each other during closing of the curtain by pivoting of these curtain strips into the curtain plane.

The principal disadvantage of this known construction is that opening and closing of the curtain is not possible.

In further development of the strip curtain of the type under consideration, there is known from Swiss Pat. No. 608,858 a curtain system in which there is provided not only the pivot movement of the curtain strips but also their sliding, and in which only a single operating element is needed for both movements.

In place of the rack, a drive tape is provided which can be displaced over the whole curtain length. In order that the displacement movement be automatically started after pivoting of the curtain strips, it is necessary that the pinions are capable of pivoting at predetermined frictional relationships. The projections mounted on the pivot axis, which engage the curtain rod, prevent pivoting of the pivot axis in their engaged position so that the pinions, which are fixedly attached to the pivot axis, are entrained by the drive tape with which they are permanently engaged upon displacement of the glide elements of the curtain strip. When the glide elements contact each other during opening of the curtain, or if the glide elements, during closing of the curtain, are held in place by the separation limiting device which connects the glide elements with each other because they have already reached their end position, then the pivotability of the pinions about the pivot axis must be insured to prevent damage. Therefore, the pinions are attached to the pivot axis through a slidable coupling, which slidable coupling must be so constructed that the moment required by the displacement resistance of the curtain is reliably transmitted in order to insure the sliding of the curtain.

The strip curtain according to Swiss Pat. No. 608,858 is of relatively sturdy construction and is particularly suitable for large installations which can also involve curved curtain rods. Heavy demands are made upon the provision of the drive tape because even a small amount of flexibility leads to non-uniform pivoting of the individual curtain strip. It has also been found that the curtain strips can be displaced by strong air currents or by unintended touching, which is esthetically undesirable.

Accordingly, it is an object of the invention to provide a strip curtain which is structurally less expensive than the known strip curtain embodying the Swiss patent and which can therefore be produced at lower cost, but without reducing the level of quality. The principle of common actuation for the displacement and pivoting of the strips is also to be retained. The strip curtain is to be particularly suitable for mass production. This object is achieved in accordance with the invention by the features defined in the characterizing portion of claim 1.

The low cost bead chain constitutes a suitable operating device which serves both for the sliding displacement of the strip package as well as for the pivoting of the individual strips. The pinion which meshes with the bead chain is no longer connected directly to the pivot axis but through a worm drive. This produces a reduction which compensates for the negative influence of a possible slight stretching of the length of the bead chain. An undesirable displacement of the strips through touching is blocked by the worm drive.

In a preferred embodiment of the invention, the flexible bead chain is closed into an endless loop and the pinions are in permanently meshing relationship either with the forward or the rearward extending portion of the chain. Thus, it is possible to lead the glide elements around curves and to pivot them in any position. The mounting of the strip curtain on sloping ceilings is also readily possible.

The strip curtain is structurally very simple and therefore reliable in operation and inexpensive in comparison with known solutions. In conjunction with various mounting simplifications, the strip curtain is particularly suitable for mass production.

For further explanation of embodiments of the invention, reference is made to the description which follows in conjunction with the accompanying drawings wherein:

FIGS. 9 through 12 are diagrammatic side views of the various possible combinations of strip curtains with common drive;

FIG. 13 is a diagrammatic top view of a strip curtain with curved configuration;

FIG. 18 is a view of the spacing plates between individual glide elements;

FIG. 19 is a top view of the same spacing plates according to FIG. 18; and

FIG. 20 shows the beads of the bead chain.

Figures 1, 2:
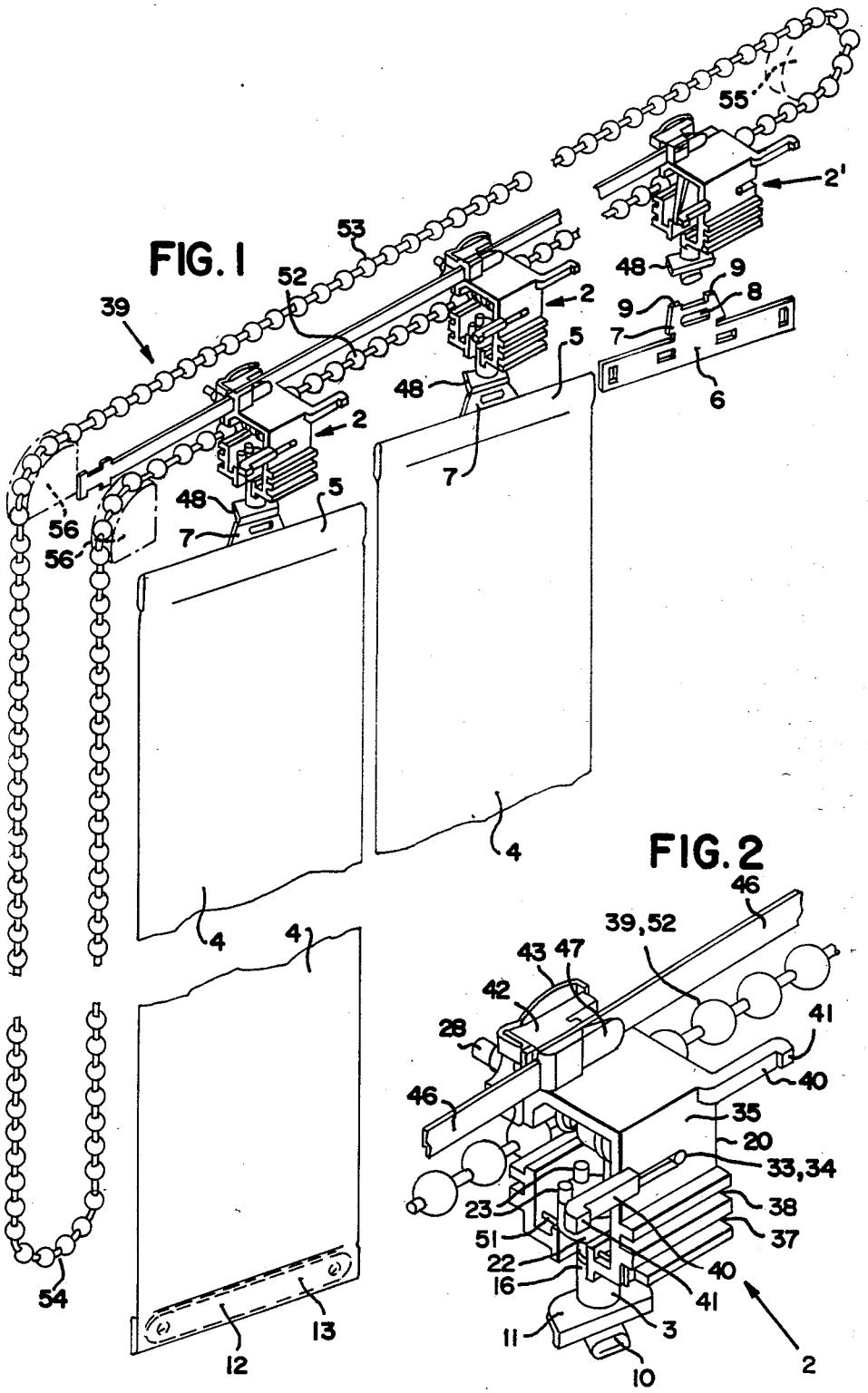
FIG. 1 is a perspective view of the glide elements of the strip curtain which are connected by separation limiting devices and in which the curtain rod has been omitted for greater clarity.
FIG. 2 is a perspective view of an individual glide element of FIG. 1 to an enlarged scale.

The strip curtain has a curtain rod 1 which is to be mounted on ceiling or wall, in which the glide elements 2 are guided in lengthwise displaceable manner. To the vertical pivot axis 3 of each glide element 2 a curtain strip 4 is removably attached in known manner. To this end, the upper edge of the curtain strip 4 is provided with a seam 5 into which an elongated stiffening plate 6 is inserted. The middle of plate 6 has upwardly extending hanger 7 with opening 8 and two projections 9 which cooperate with a corresponding projection 10 and a downwardly extending rib 11 on the pivot axis 3 to connect the curtain strip 4 with the glide element 2 in snap-in manner.

So that the individual curtain strips 4 will hang properly when mounted, weighting plates 13 are inserted into the lower seams 12. The curtain strips need not be connected to each other at the bottom as is, for example, necessary for other vertical vane arrangements. This is decoratively more desirable and makes possible free passage even through a closed curtain. However, if such connection is desired, it can be provided without difficulty.

Because the curtain strips are simple to snap in and snap out, cleaning and repairs are simplified and varying room configuration requirements can be accomodated through exchange of strips. The strips may, for example, be made of synthetic plastic, of textile materials, or of plexiglass.

Figure 3:
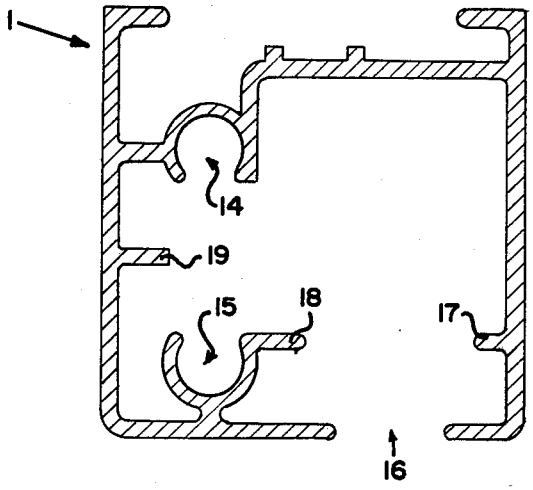
FIG. 3 is a cross section through a curtain rod of a strip curtain.
Figure 4:
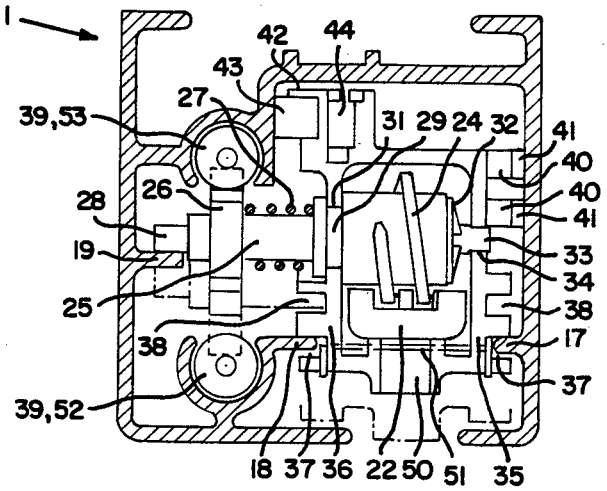
FIG. 4 is a cross section through the curtain rod of FIG. 3 within which is borne a glide element according to FIG. 2.
Figure 5:
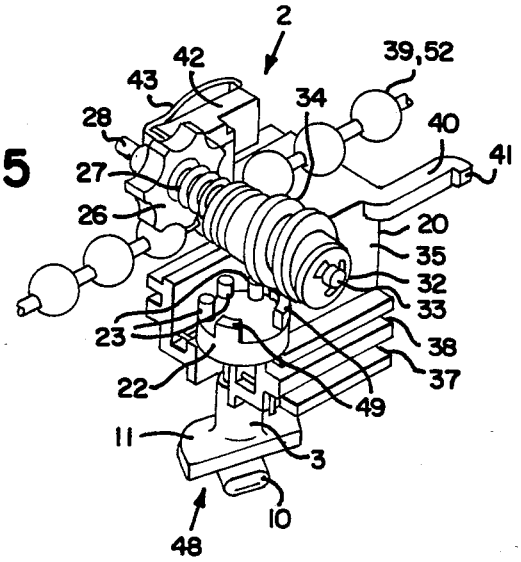
FIG. 5 is a view of the glide element according to FIG. 2 in which certain portions of the housing have been omitted for better visibility.
Figure 6:
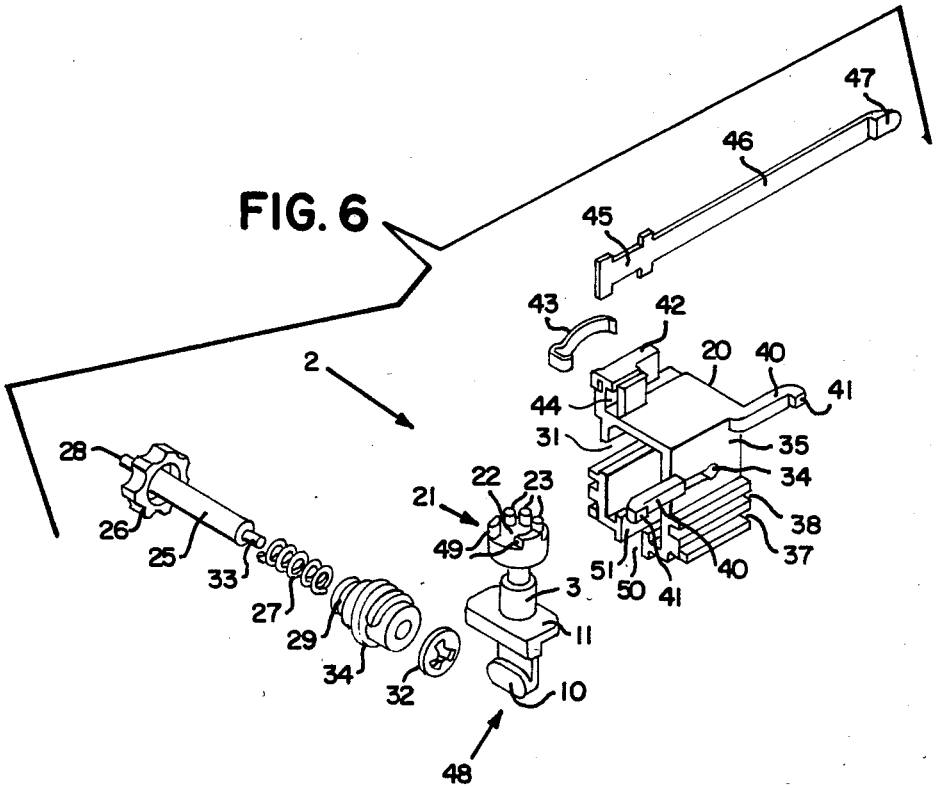
FIG. 6 shows the glide element of FIGS. 2 and 5 in an exploded view.

According to FIGS. 3 and 4, the curtain rod 1 has a substantially square, hollow beam configuration of light metal, in which there are provided two symmetrically opposed guide channels 14, 15 located in a common vertical plane, for a bead chain 39. The edges of guide channels 14, 15 partially encircle the beads of the bead chain 39 so that this chain cannot fall out of the channels. The beads 69 are fixed upon the relatively inextendable connecting links. Preferably, they have the cross-sectional shape of a gear tooth (FIG. 20).

At the bottom, the curtain rod 1 is provided with a longitudinal slot 16 through which the pivot axes 3 of the glide elements 2 project downwardly. In addition, in the interior of the curtain rod, there are a plurality of longitudinal ribs 17, 18, 19 for the guidance of glide elements 2.

Each glide element 2 comprises a housing 20 in which there is positioned a pivot element 21. In the hollow pivot axis 3 of pivot element 21, there is inserted the curtain holder 48. The pivot element 21 further bears on top a worm gear 22 with vertical lands 23 which mesh with a worm 24. The worm 24 is positioned freely rotatably on a horizontal shaft 25 to which is attached a pinion 26. The curtain holder 48 and the pivot element 21 could also be made as a single unit.

Between pinion 26 and worm 24, there is a spring 27 under tension which transmits the turning moment from pinion 26 to the worm 24. When the turning moment of the pinion 26 exceeds a predetermined value, which depends upon the spring's characteristics, the spring acts as a slip coupling and permits the pinion 26 to freely rotate with respect to the worm 24 while the worm 24 is blocked.

The end position of the worm drive 22, 24 is determined by two broader pins 49 on the worm gear. In the end position, one or the other end of the worm butts against the broader pins 49. Jamming in the end position is impossible.

The shaft end 28 with pinion 26 rests, after mounting of the glide element, upon rib 19 of curtain rod 1. The worm 24 is provided with an encircling groove 29 into which penetrate the edges of opening 31 in housing 20, thereby forming a bearing for the worm 24. By means of resilient disc 32, the worm is attached to shaft 25. The end 33 of the shaft which is remote from the pinion, is retained in an additional lateral opening 34 in housing wall 35.

Both openings 31, 34 are slot shaped and open on one side so that the shaft with the worm can be slipped into the housing. The interiors of the openings 31, 34 are somewhat widened to form the actual bearings. The mounting takes place by sliding in and "clicking" in of the shaft and of the worm into the bearings. It is free of difficulty and economical of time.

The lateral housing walls 35, 36 are each provided with two parallel grooves 37, 38 extending in the longitudinal direction of the curtain rod and positioned one above the other. It is into these that the two inner ribs 17, 18 of curtain rod 1 are intended to penetrate. As is apparent from FIG. 4, the glide element 2 can be slid into the curtain rod in such a manner that the ribs 17, 18 penetrate either into the lower housing groove 37 or into the upper housing groove 38. In the first case, the pinion 26 meshes with the lower portion 52, in the latter case with the upper portion 53 of bead chain 39.

To insure reliable guidance in curtain rod 1, there are provided two extension arms 40 laterally on housing 20 of the glide element 2. The ends of the extension arms 40 are provided with sliding surfaces 41, which contact the inner wall of the curtain rod 1 and thereby stabilize the glide element 2. On the opposite side, the top of the housing 20 includes a block shaped element 42 in which a leaf spring 43 is placed under tension and which bears resiliently against the adjacent inner wall of the curtain rod.

In addition to their stabilizing function, the spring 43 and the sliding surfaces 41 function as brake a for the glide element. The spring 43 brakes the glide element within the curtain rod 1 at times when the pivotal movement of strips 4 is possible, even in intermediate positions of the glide elements 2. The spring 43 brakes develops braking forces which are somewhat more than the frictional forces of the pinion 26 against the worm 24 which are produced by spring 27. Through these two springs 43, 27, the problem of different frictions is thus solved in simple and practical manner.

The block 42 further exhibits a follower element or slot 44 in which there is anchored the end 45 of a pull element or platelet 46 which limits the longitudinal separation, and whose other end carries projection 47. In mounting the glide element 2, the free portion of each spacing platelet is inserted into the slot 44 of an adjoining glide element 2. In each slot 44 there are therefore two platelets 46, namely that which belongs to its own glide element 2 and is firmly attached thereto, and that which belongs to adjoining glide element 2 and is displaceable in the slot up to the limiting position.

The closed loop bead chain 39 is of endless configuration so that the two portions 52, 53 are always within the same guidance channels 14,15. At one end of curtain rod 1, the bead chain is looped about a turnabout roller 55, and at its other end two turnabout surfaces 56 are provided which form the operating loop 54. The turnabout points 55, 56 are positioned in housings which are not further illustrated, which are mounted at the ends of the curtain rod 1. Instead of a loop, there could also be provided two turnabout rollers which would be actuatable by a crank or by a motor, this drive being capable of taking place at one end or the other of the curtain rod. For higher loads, a motor could also be attached at the two ends, respectively.

Figure 7:
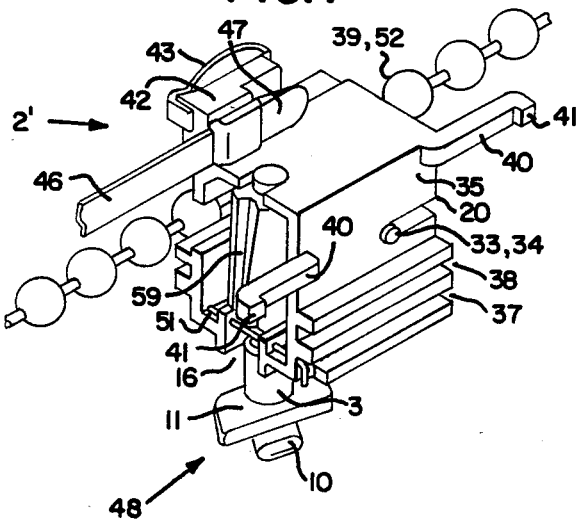
FIGS. 7 and 8 show a further embodiment of a glide element in an overall view (FIG. 7) and with certain portions omitted (FIG. 8)
Figure 8:
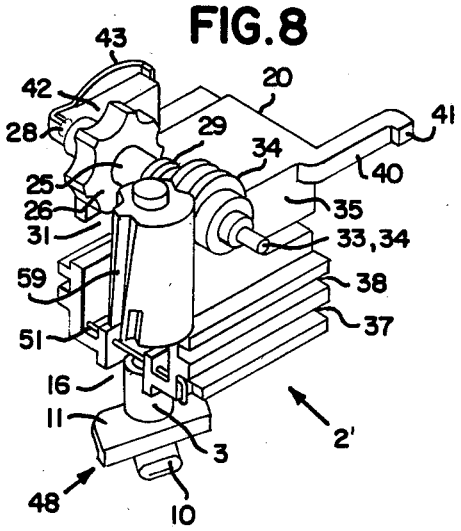

The embodiment of glide element 2' according to FIGS. 7 and 8 does not depart significantly from the first embodiment. The principal difference lies in worm gear 59, which takes the form of a pinion with diagonal gear teeth. Here too, the limiting contact is determined by the end positions of the worm drive. The glide element 2' is constructed more sturdily than that of FIGS. 2 and 4 and serves primarily as the pulling element which is connected ahead of the other glide elements as shown in FIG. 1.

Figure 14:
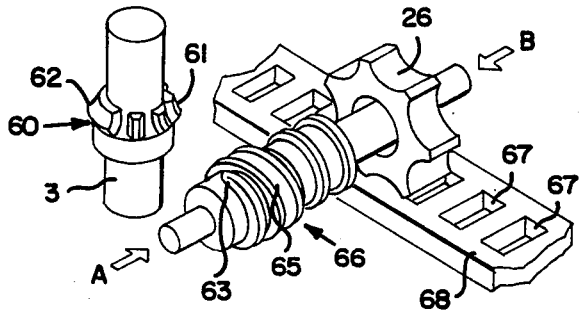
FIG. 14 shows the detail of the worm drive of a glide element which is driven by a tape.
Figure 15:
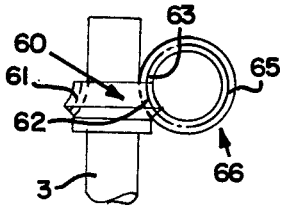
FIG. 15 is a view from the direction of Arrow A of the worm drive of FIG. 14.
Figure 16:
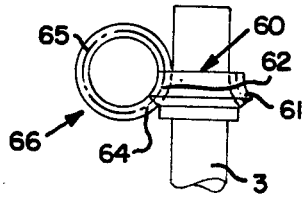
FIG. 16 is a view from the direction of Arrow B of the worm drive of FIG. 14.

To provide unambiguous, non-jamming end positions, the worm drive for the glide elements can generally be constructed as shown in FIGS. 14 through 16. The gear teeth group 60 of the worm gear mounted upon pivot axis 3 has teeth only its operating region 61, being without teeth in its other region 62. The ends 63, 64 of the worm thread 65 of worm 66 are reduced in steps. In the end position of the worm drive, the worm ends 63, 64 of the worm are adjacent either the top or the bottom of the toothless region 62 of the worm gear.

Figure 17:
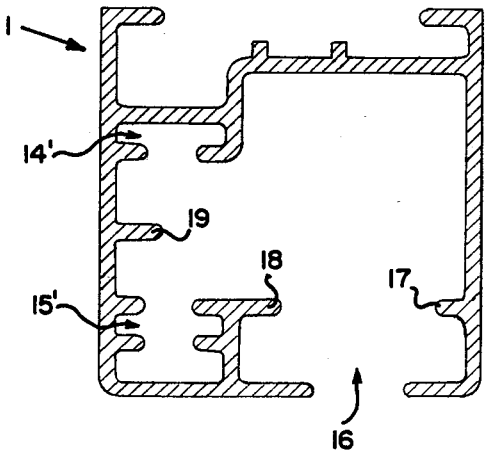
FIG. 17 shows a curtain rod for a tape drive.

In this illustrative embodiment, the drive device is an endless tape 66 provided with opening 67 which meshes with the pinion 26. The curtain track (FIG. 17) is provided with corresponding guidance grooves 14', 15' for the tape 68.

In a further embodiment of the invention, it is possible to provide the spacing platelets themselves with braking means, instead of the braking springs 43 bearing against the curtain rod. As is apparent from FIGS. 18 and 19, the end of each platelet 46 is provided with an inwardly protruding projection 70 which bears against the adjacent platelet 46. During pulling apart of the glide elements, the friction produced by these projections and the elastic deformation of the platelets produces friction which provides the desired braking function. Here, too, the frictional forces developed by the slip coupling 27 must be less than the frictional forces developed by the projection 70 in order to insure trouble free operation of the curtain.

The strip curtain described above operates as follows:

When the curtain is open, the curtain strips 4 are drawn to the side in a small package. If then, in order to close the curtain, a pull is exerted upon operating loop 54, the forwardly and rearwardly extending portions 52, 53 of bead chain 39 move in opposite directions within their guide channels 14, 15 in curtain rod 1. The portion of chain 39 which meshes with pinions 26 first produces pivoting of all axes 3 of glide elements 2. This pivotal movement is limited by the end positions of the worm drive. Upon further pull on the loop, the strip package is displaced by the bead chain 39, lengthwise of the curtain rod. Upon reaching the spacing determined by the platelet 46 from the end of the track, the last glide element stops, then the next to last one and so forth, until the entire curtain has been drawn apart and the first glide element bears against the opposite end. As soon as a glide element stops in its predetermined position, the pinion 26 thereof which is in mesh with the bead chain, rotates freely, due to the slip coupling.

During opening of the curtain, all of curtain strips 4 are initially pivoted in analogous fashion and thereafter the glide elements are displaced in the opposite direction to form a package. It should be noted that, due to the spring brake 43 the pivoting of the elements can take place at any time in any drawn condition of the curtain by appropriate operation of loop 54. Since each strip 4 can be controlled in each position, the pivoting is also possible around a curve.

The use of this strip curtain is extraordinarily varied and can be suited to all sizes of windows and rooms, both as sunscreen and for purely decorative purposes. Due to the interchangeability of the strips, particular configurational affects can be obtained quickly and without much modification effort.

With the same common drive, it is possible to build up single, multiple and curved curtain systems as illustrated in FIGS. 9 through 13.

In FIG. 9, there is again shown a one-part arrangement in which the curtain rod is again designated with reference numeral 1, the curtain strips with reference numeral 4, and the drive with reference numeral 57.

In the two-part embodiment according to FIG. 10, the pinions 26 mesh on one side with the upper chain portion 53 and on the other side with the lower chain portion 52. This has the effect that, upon operation of the loop 54 or drive 57, the two groups of glide elements 2 move toward each other or apart from each other.

In FIG. 11, three one-part embodiments are hung in series, and again only the single bead chain is necessary for operation. In FIG. 12, two two-part arrangements are connected together.

FIG. 13 shows a curtain rod with a curved track portion 58. The drive 57 or the loop 54 can again be attached at one or the other end of the rod. The curtain rod could also be assembled from several track segments of desired curvature, and only the minimum radius of curvature would impose certain limits.

We claim:

1. A strip curtain having glide elements guided by a curtain rod and connected to each other by separation limiting means, and which support freely hanging curtain strips from vertical pivot axes, each of which is rotatable in limited manner by an operating means including a pinion which is connected through a slip coupling with an associated pivot axis and in which the pinion meshes with a drive means which is slidably carried by the curtain rod, wherein the drive means meshing with the pinion is a bead chain, the pinion is connected with the pivot axis through a worm drive, and the slip coupling is positioned between the pinion and the worm drive.

2. The curtain of claim 1, wherein the worm drive includes a worm which is supported freely rotatably upon a horizontal pinion shaft and which meshes with a worm gear mounted on the pivot axis, and the slip coupling is a spring mounted on the shaft and under tension between the pinion and the worm.

3. The curtain of claim 2, wherein the pinion shaft and the worm are engaged in snap-in manner in a housing of the glide element.

4. The curtain of claim 2, wherein the worm gear has teeth only in an operating portion thereof, and wherein ends of the worm are reduced in size in steps and are adapted to bear against toothless portions of the worm gear.

5. The curtain of claim 1, wherein end positions of the worm drive determine limits for the pivot axis.

6. The curtain of claim 1, wherein the bead chain is connected together into an endless loop, in which forwardly and rearwardly extending portions are respectively located within an upper and lower guide channel within the curtain rod, and wherein the glide elements are engaged within the curtain rod so that their pinions mesh either with the upper or the lower chain portion.

7. The curtain of claim 6, wherein the curtain rod has internal longitudinally opposing ribs, wherein each glide element is provided with two pairs of guidance grooves positioned one above the other, and wherein either the lower or the upper guidance groove engages the ribs.

8. The curtain of claim 1, wherein the glide element has a leaf spring which laterally presses against an inner wall of the curtain rod and serves as a friction brake.

9. The curtain of claim 8, wherein the worm drive includes a worm which is supported freely rotatably upon a horizontal pinion shaft and which meshes with a worm gear mounted on the pivot axis, and the slip coupling is a spring mounted on the shaft and under tension between the pinion and the worm.

10. The curtain of claim 9, wherein the frictional forces developed at the slip coupling are less than the frictional forces developed at the leaf spring.

11. The curtain of claim 1, wherein the separation limiting means is a longitudinal platelet with an attachment point and an end bearing, wherein one such platelet is firmly attached to each glide element, and wherein protruding portions of said platelet are displaceable up to the end bearing in a slot of an adjoining glide element.

12. The curtain of claim 11, wherein each platelet is provided with at least one inwardly protruding projection which lies against an adjoining platelet, and wherein the platelets combine to produce a braking action during sliding displacement of the platelets.

13. The curtain of claim 12, wherein the worm drive includes a worm which is supported freely rotatably upon a horizontal pinion shaft and which meshes with a worm gear mounted on the pivot axis, and the slip coupling is a spring mounted on the shaft and under tension between the pinion and the worm.

14. The curtain of claim 13, wherein the frictional forces developed at the slip coupling are less than the frictional forces developed at the projections.

15. The curtain of claim 1, wherein the glide elements comprise a pull element and follower elements connected thereto.

16. The curtain of claim 1, wherein the bead chain forms an operating loop in addition to serving as drive means.

17. The curtain of claim 1, wherein beads comprising the bead chain have the cross-section of gear teeth.

18. A strip curtain for supporting a plurality of generally vertically oriented, freely hanging curtain strips from a curtain rod, for rotation about a generally vertical axis and for sliding movement along said curtain rod responsive to a single drive means, comprising:

a plurality of glide elements guided by said curtain rod and each including a pivot which is rotatable within said glide element about a pivot axis and which includes means for engaging said curtain strips;

operating means for rotating said pivot in limited manner about said pivot axis and including a worm drive for rotating said pivot, and a pinion which is spaced from, and coaxially and rotatably associated with, said worm drive; and a slip coupling positioned between and operatively connecting the pinion and the worm drive;

wherein said drive means is slidably carried by said curtain rod for engagement with said pinion to both axially rotate the pivots of said glide elements, and slide the glide elements along the curtain rod, responsive to operation of said slip coupling.

19. The curtain of claim 18, wherein said slip coupling is a spring coaxially associated with said pinion and said worm drive such that opposite ends of said spring are in engagement with side portions of said pinion and said worm drive.

20. The curtain of claim 19, wherein said spring is under tension so that turning moments of said pinion which exceed a selected value cause said pinion to rotate with respect to said worm drive, and turning moments of said pinion which do not exceed said selected value cause said pinion and said worm drive to rotate together.

21. The curtain of claim 20, wherein said turning moments are developed by said single drive means only.

22. The curtain of claim 21, wherein said pinion is permitted to rotate with respect to said worm drive when said drive means operates to slide said curtain strips along said curtain rod, and wherein said pinion and said worm drive rotate together when said drive means operates to rotate said curtain strips about said vertical axis.

23. The curtain of claim 18, wherein said drive means is a bead chain.

24. The curtain of claim 18, wherein said drive means is a tape.

25. The curtain of claim 18, wherein said drive means tangentially engages said pinion and extends perpendicular to the axis of said pinion, wherein said pinion, slip coupling and worm drive are coaxially disposed along the axis of said pinion, and wherein said pivot is perpendicular to the axis of said pinion and said drive means.

26. The curtain of claim 20, wherein the axis of said pivot and the axis of said curtain strip are coaxial.

27. The curtain of claim 18, which further comprises separation limiting means operatively connecting adjacent pairs of glide elements.

* * * * *